US009421407B2

(12) United States Patent
Colletto

(10) Patent No.: US 9,421,407 B2
(45) Date of Patent: Aug. 23, 2016

(54) STARTING BLOCK FOR SWIMMING POOLS

(71) Applicant: A&T EUROPE S.P.A., Castiglione Delle Stiviere (IT)

(72) Inventor: Roberto Colletto, Padenghe sul Garda (IT)

(73) Assignee: A&T EUROPE S.P.A., Castiglione Delle Stiviere (MN) (IT)

( * ) Notice: Subject to any disclaimer, the term of this patent is extended or adjusted under 35 U.S.C. 154(b) by 349 days.

(21) Appl. No.: 14/098,302

(22) Filed: Dec. 5, 2013

(65) Prior Publication Data

US 2014/0165282 A1 Jun. 19, 2014

(30) Foreign Application Priority Data

Dec. 5, 2012 (IT) ..... MI2012A2079

(51) Int. Cl.
*A63B 5/10* (2006.01)
*E04H 4/14* (2006.01)

(52) U.S. Cl.
CPC ..... *A63B 5/10* (2013.01); *A63B 2225/093* (2013.01); *E04H 4/144* (2013.01)

(58) Field of Classification Search
CPC ..... A63B 5/00; A63B 5/10; A63K 3/023
USPC ..... 4/496
See application file for complete search history.

(56) References Cited

U.S. PATENT DOCUMENTS 4,134,583 A 1/1979 Davidson

FOREIGN PATENT DOCUMENTS

WO WO 2011012261 A2 * 2/2011 ..... A63B 5/10

* cited by examiner

*Primary Examiner* — Tuan N Nguyen
(74) *Attorney, Agent, or Firm* — Hedman & Costigan, P.C.; James V. Costigan; Kathleen A. Costigan

(57) ABSTRACT

Herein described is a starting block (10) for swimming pools comprising a base portion (12), constrainable to the perimetrical structure of the swimming pool at one of its head vertical walls, an upper walkable portion (14), supported by the base portion (12) and aligned with the head vertical wall of the swimming pool so as to be used as a platform by a swimmer, and one or more handgrips (16), protruding from the base portion (12) towards the internal part of the swimming pool and useable by the swimmer during the starting stages of a swimming competition. To the starting block (10) there is operatively connected a means (18) for supporting the feet of the swimmer, provided with a moving system which allows such support means (18) to move between a first operating position and a second rest position, wherein such support means (18) is outside the swimming pool.

6 Claims, 7 Drawing Sheets

STARTING BLOCK FOR SWIMMING POOLS

The present invention regards an improved starting block for swimming pools, which can be used, in particular but not exclusively during swimming competition training and racing sessions.

The current sports regulations which define the rules for swimming competitions (FINA regulations) provide for that the platform or starting blocks be made according to specifically outlined ergonomic and dimensional characteristics. The blocks should for example be built so as to allow each athlete, in the forward starts (freestyle, butterfly, breaststroke), to grip the front part and the sides of the start platform. On the other hand, the backstroke starting requires that there be provided proper handgrips on the front part of the blocks.

In particular, in the start of the backstroke swimming competitions the current sports regulations provide for that each swimmer be partly immersed in water, with the feet resting on the head vertical wall of the swimming pool and the hands gripping the handgrips that the starting blocks are provided with. Usually the swimmer, using the force of the hands, lifts himself in compression and then launches himself, with the back facing downwards, in the swimming direction due to the thrust exerted by the feet on the wall of the swimming pool.

One of the problems that occur during the start of the backstroke swimming competitions lies in the fact that the efficiency of the start action depends both on the positioning of the feet of the swimmer with respect to the wall of the swimming pool and especially on the friction between the soles of the feet and such wall. During the starting stage the swimmer launches himself upwards and the thrust action is thus not orthogonal to the wall of the swimming pool, but inclined, with a component of the motion parallel to the wall which induces the sliding.

Up to date, a possibility for avoiding the aforementioned drawback is that of making the head vertical wall of the swimming pool non-slippery. However, there are objective limits to the effect that can be obtained, for example for the sake of pleasantness of the wall to touch and for the sake of facilitating the operations of cleaning the wall itself.

In addition, a normal head vertical wall of a swimming pool does not allow the swimmer to maintain a position of the feet perfectly orthogonal with respect to the rest of the body during backstroke upward thrust starting stage. This prevents the swimmer from developing the maximum effort possible in the upwards thrust direction.

Another possibility for avoiding the aforementioned drawback could be that of inclining at least part of the head wall of the swimming pool. In such case, in the upwards thrust stage, the position of the feet of the swimmer with respect to the rest of the body could be that of 90°, ideal for obtaining the maximum effect from the exerted muscle effort. However, it should be observed that the head wall of a swimming pool for swimming competitions, excluding the starting stages of such competitions, should always remain vertical and free from obstacles so as to allow the subsequent turning of the swimmers.

U.S. Pat. No. 4,134,583 describes a device for supporting the feet of the swimmer capable of at least partly overcoming the aforementioned drawbacks. The support device U.S. Pat. No. 4,134,583, connected to the starting block by means of belts, is however poorly stable and scarcely adjustable so as to suit the various needs of the swimmers.

Thus, an object of the present invention is that of providing an improved starting block for swimming pools, particularly but not exclusively useable during swimming training and race sessions, that is capable of overcoming the aforementioned drawbacks of the prior art in an extremely simple, inexpensive and particularly functional manner.

In detail, an object of the present invention is to provide an improved starting block for swimming pools which is capable of providing an ideal support for the feet of each swimmer during the backstroke swimming competition starts, regardless of the type of head wall of the swimming pool on which such starting block is installed.

Another object of the present invention is to provide an improved starting block for swimming pools which allows adjusting the start position to suit the needs of each swimmer.

A further object of the present invention is to provide an improved starting block for swimming pools capable of allowing performing, in an easy and safe manner, the start of swimming races of any recognized style, as well as using the swimming pool for training and recreational purposes in an entirely safe manner.

These objects according to the present invention are attained by providing an improved starting block for swimming pools, that can be particularly but not exclusively used for swimming training and race sessions, as outlined in claim 1.

Further characteristics of the invention are outlined by the dependent claims, which are an integral part of the present description.

The characteristics and advantages of an improved starting block for swimming pools according to the present invention shall be more apparent from the following exemplified and non-limiting description with reference to the attached schematic drawings wherein.

Figure 1:
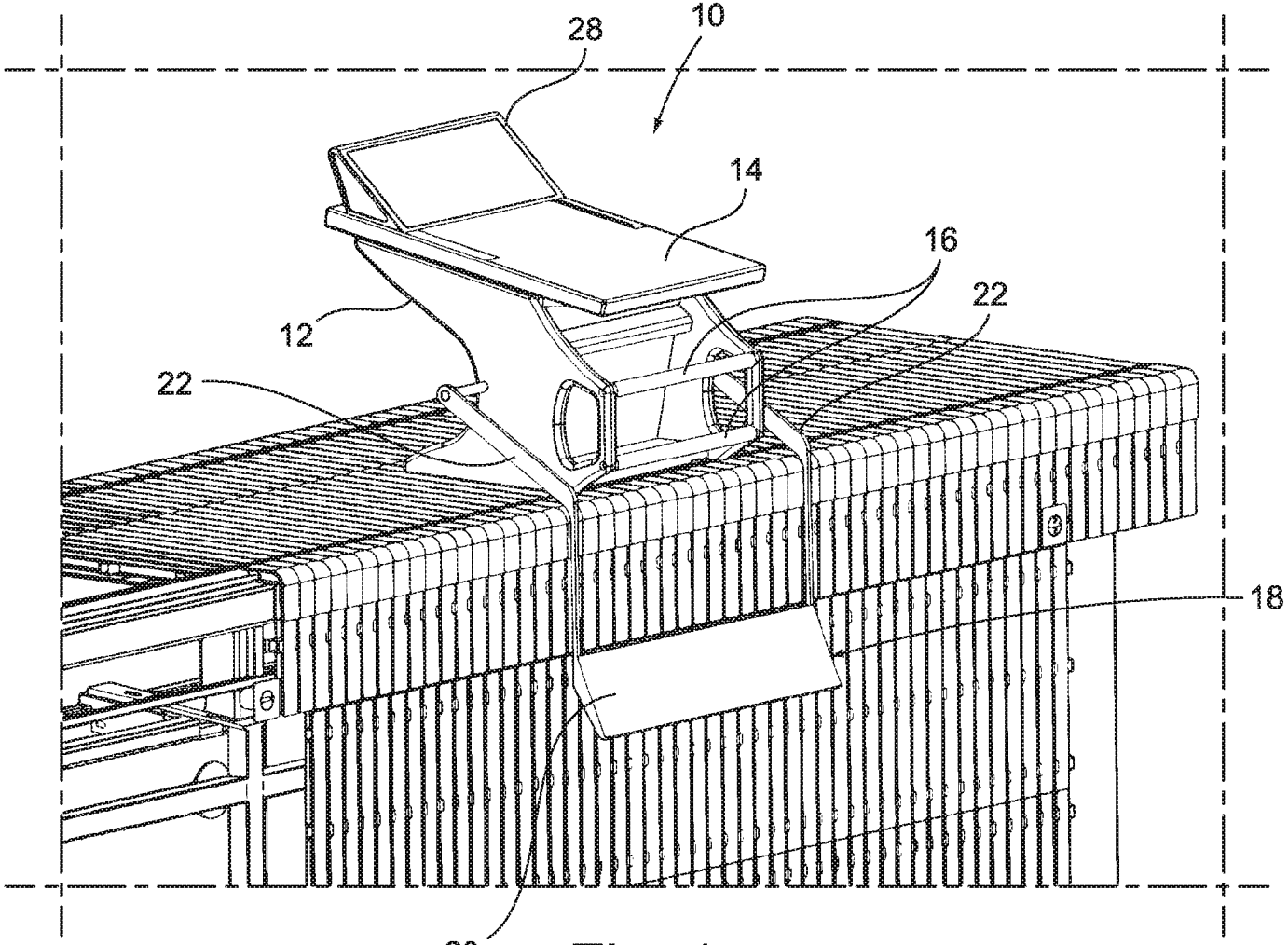
FIG. 1 is a perspective view of a first preferred embodiment of the improved starting block for swimming pools according to the present invention, shown in a first operating configuration.

With reference to the figures, there is shown an improved starting block for swimming pools according to the present invention, indicated in its entirety with reference number 10. The starting block 10 comprises, in a per se known manner, a base portion 12, constrainable to the perimetrical structure of the swimming pool at one of its head vertical wall, and an upper walkable portion 14, supported by the base portion 12 and aligned with the head vertical wall of the swimming pool so as to be used as a platform by a swimmer. The starting block 10 also comprises one or more handgrips 16, protruding from the base portion 12 towards the internal part of the swimming pool and useable by the swimmer during the start stages of a swimming competition.

According to the invention, to the starting block 10 there is operatively connected a means 18 for supporting the feet of the swimmer, provided with a moving system which allows such support means 18 to move between a first operating position, wherein such support means 18 leans against the head vertical wall so as to form a step which is inclined with respect to such head vertical wall and facing upwards, and a second rest position, wherein such support means 18 is outside the swimming pool and does not represent an obstacle for the swimmers who are inside such swimming pool or on the starting block 10.

In other words the support means 18, when it is immersed in the swimming pool and leans against the head vertical wall, forms an inclined step which confers an ideal support for the feet of the swimmer during the thrust or upwards thrust stage of the backstroke start. The inclination of the support means 18 with respect to the head vertical wall of the swimming pool may for example be regulated so as to always form an ideal angle for the maximum efficiency of the thrust action of the swimmer. Similarly, also the depth of the support means 18 with respect to the edge of the swimming pool may be adjustable according to the specific needs of each swimmer.

Immediately after the start of the swimmer the support means 18 may be moved to a rest position in which it does not represent an obstacle, or it may be even removed from the starting block 10. Thus, it is possible to leave the head vertical wall of the swimming pool free during the subsequent turning stage of the swimming competition.

According to the current sports regulations the support means 18, in its operating position, is configured so as to be at least partly immersed in the water of the swimming pool, given that the swimmers start with the feet under water in the official backstroke races. However, it cannot be excluded that the support means 18, in its operating position, may be on the water surface or even above the water surface, for example following possible modifications of the sports regulations or allowing performing other activities different from the backstroke swimming competitions starts.

Figure 2:
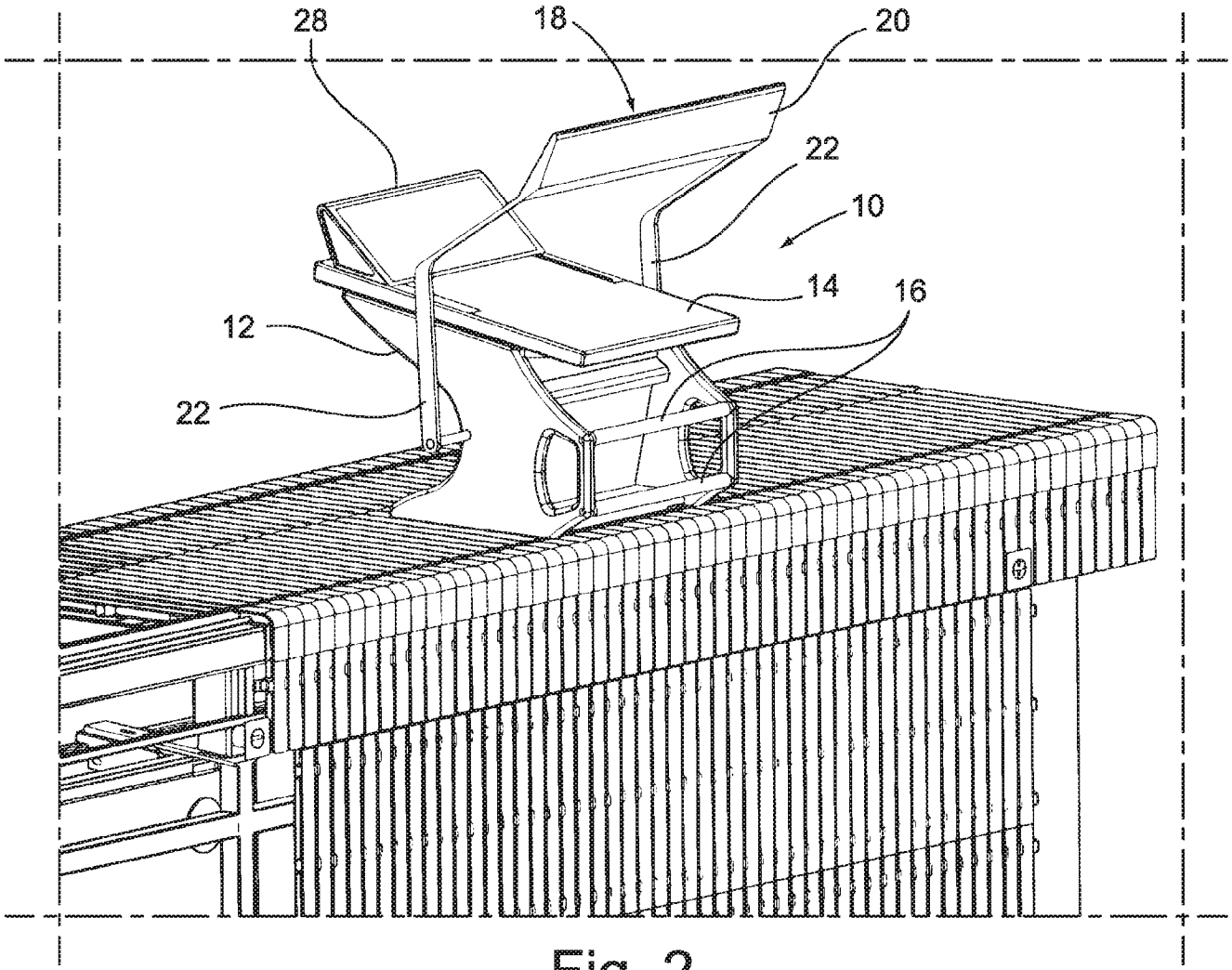
FIG. 2 is a perspective view of the starting block of FIG. 1, shown in an intermediate configuration.
Figure 3:
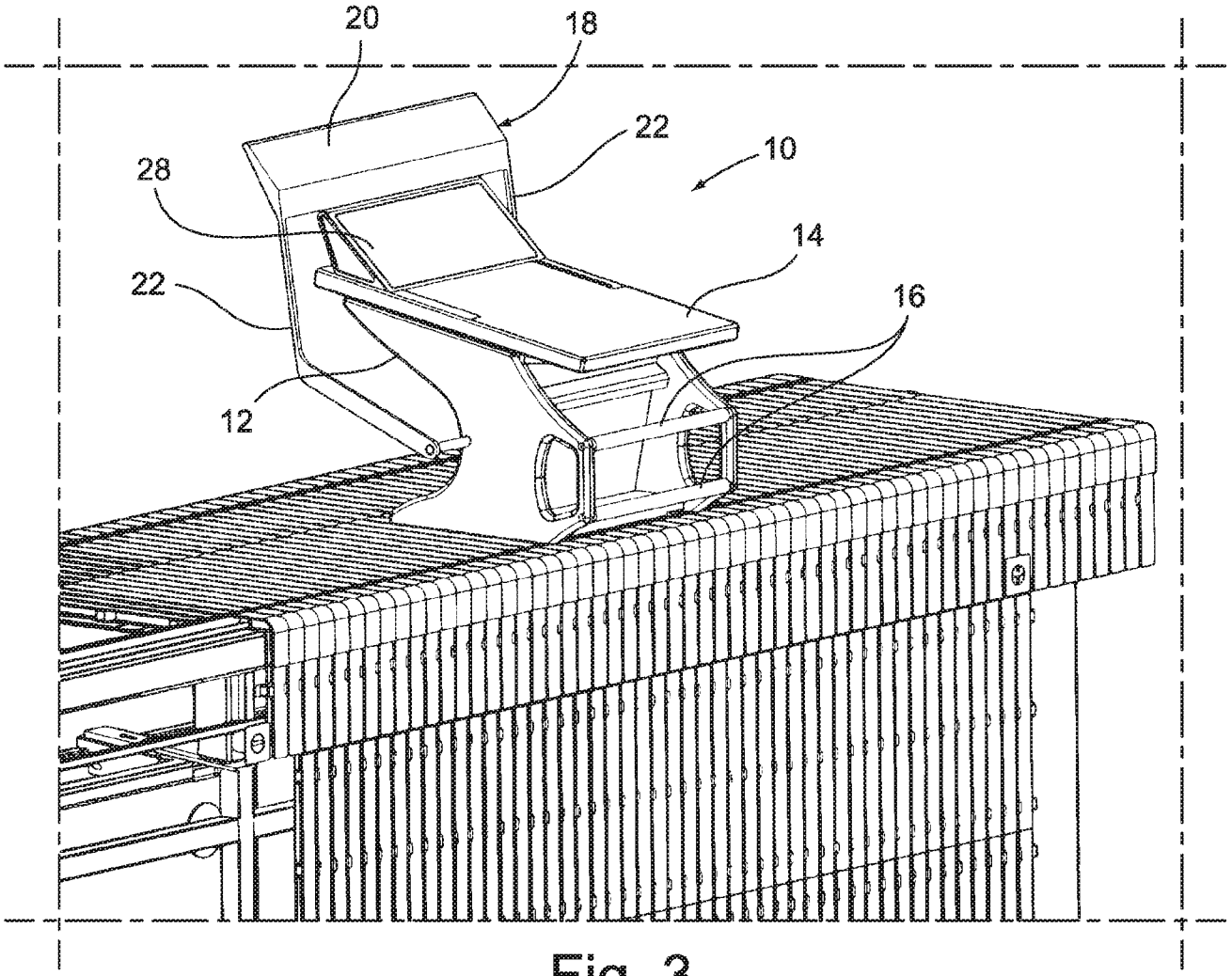
FIG. 3 is a perspective view of the starting block of FIG. 1, shown in a second operating configuration.

According to the first embodiment of the starting block 10, shown in FIGS. 1 to 4, the support means 18 is made up of a plate 20 hinged to the base portion 12 through a rigid frame which allows rotating such support means 18 to put it away, in its rest position, on the rear of the starting block 10 (see FIGS. 2 and 3). The rigid frame may be conveniently made up of two curved bars 22, one for each side of the starting block 10, which in the operating position of the support means 18 are arranged substantially adjacent to the edge and to the head vertical wall of the swimming pool, so as to have the least possible bulk.

Figure 4:
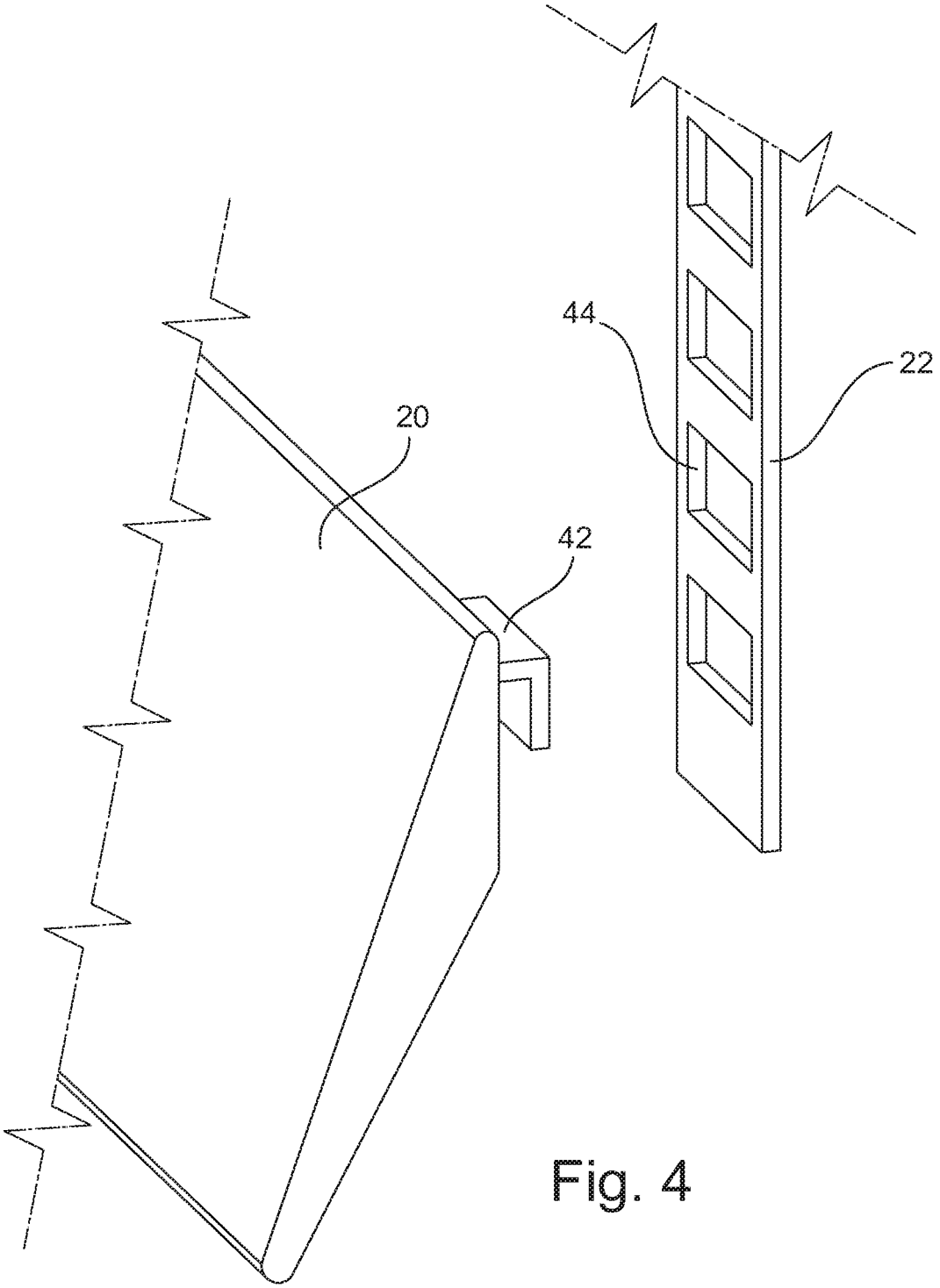
FIG. 4 is a detailed view of the means for adjusting the starting block of FIG. 1.

As shown in FIG. 4, the plate 20 may be provided with means for adjusting its position with respect to the rigid frame, so as to be able to determine the position of the support means 18 with respect to the head vertical wall of the swimming pool. For example, the adjustment means may be made up of hooks 42, integral with the plate 20, which can be selectively engaged in a plurality of slots 44 arranged in predefined positions along each curved bar 22.

The support means 18 may in any case be provided with any moving system which allows the passage thereof from the operating position to the rest position and vice versa, such as for example an articulated parallelogram. The movement of the support means 18 when passing from the operating position to the rest position may be performed manually and, in such case, it could be facilitated by springs and/or gas dampers part of the relative moving system. The moving of the support means 18 when passing from the operating position to the rest position may even be made automated, and in such case, the moving system may be mechanical, electromechanical, pneumatic or of any other type and it may be provided with a control and management electronic system (not shown).

In the case where the moving system is automated, the control of the action of moving the support means 18 from the operating position to the rest position could be imparted manually by a designated person, such as for example a lane judge, using the control and management electronic system. Alternatively, such control and management electronic system could be connected to the start signal of the swimming competition for activating, with suitable delay, the control of the movement action of the support means 18 from the operating position to the rest position. During training, the control of the movement action of the support means 18 from the operating position to the rest position could be activated by the swimmer with a predetermined delay, capable of allowing him to prepare and start before such support means 18 moves towards its rest position.

The automated version of the support means 18 shall obviously comply with the current regulations (directive 2006/42/EC or "machinery directive") of the field in force, as well as comprise instruments for preventing the risks of impact with the people present in the area surrounding the starting block 10. The support means 18 may for example be provided with a torque limiting device, rounded portions, soft buffers, etc., while the relative control and management electronic system shall always guarantee a suitable movement speed when passing from the operating position to the rest position and vice versa.

Figure 5:
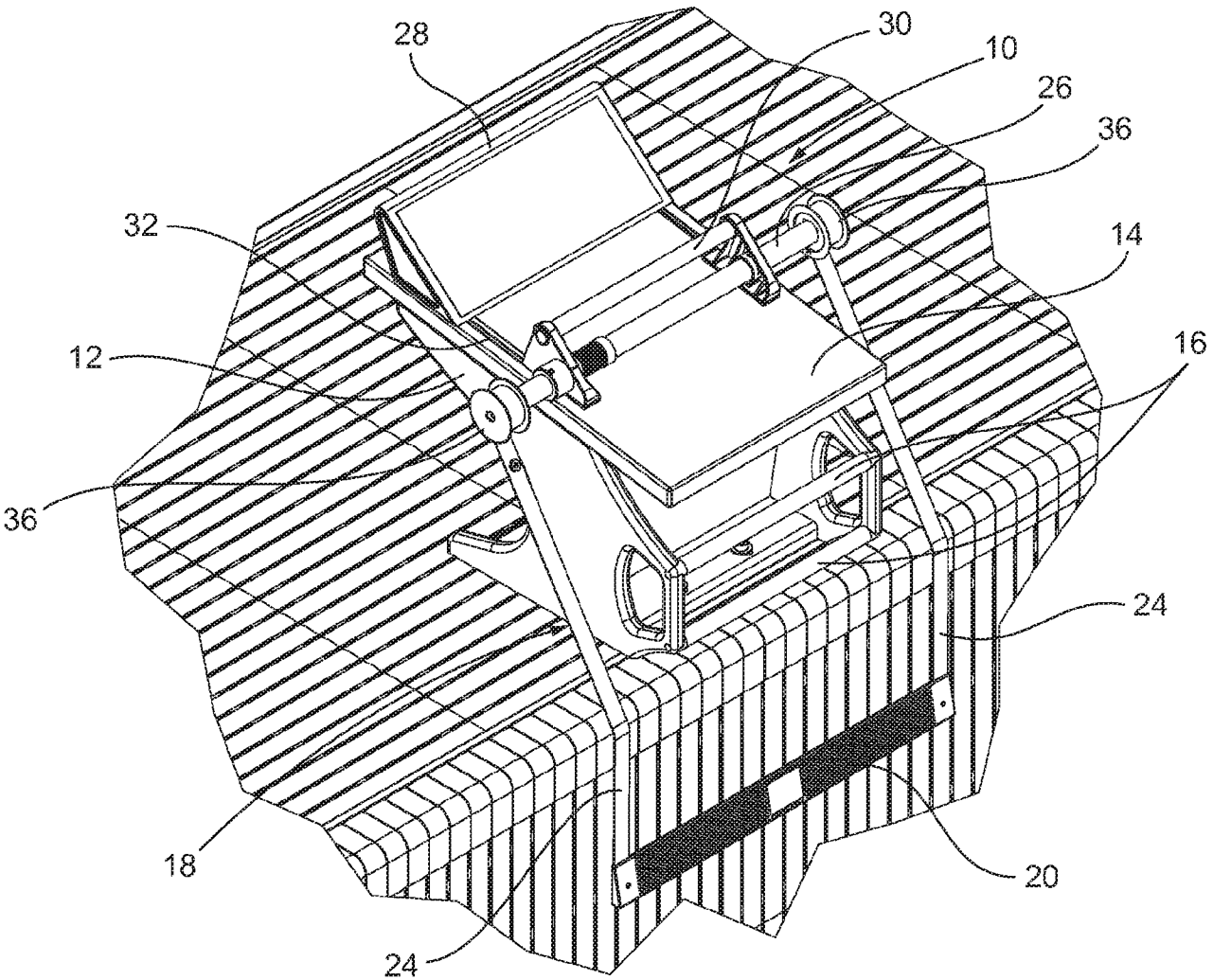
FIG. 5 is a perspective view of a second preferred embodiment of the improved starting block for swimming pools according to the present invention, shown in a first operating configuration.
Figure 6:
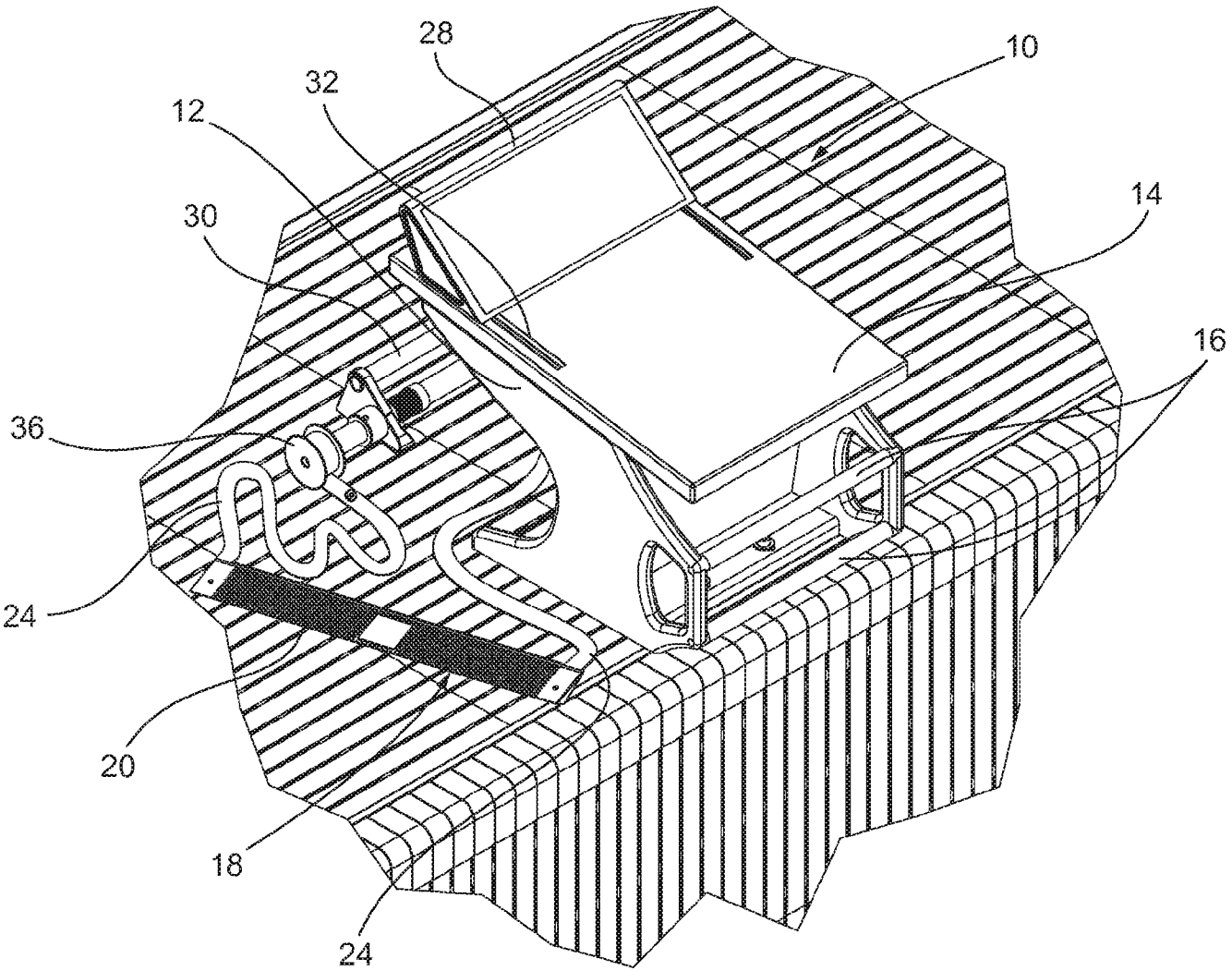
FIG. 6 is a perspective view of the starting block of FIG. 5, shown in a second operating configuration.

According to the second embodiment of the starting block 10, shown in FIGS. 5 and 6, the support means 18 is made up of a plate 20 constrained to the starting block 10 by means of belts 24. The belts 24 may be adjustable length-wise and may be removably constrained in turn to the starting block 10, for example through a bar 26. The bar 26 may be rotatably connected to a support framework 30 removably constrained to the starting block 10. The rotation of the bar 26 around the axis thereof with respect to the support framework 30 and, hence, with respect to the starting block 10, allows obtaining the length-wise adjustment of the belts 24, which in turn determines the position of the support means 18 with respect to the head vertical wall of the swimming pool.

The bar 26 and the relative support framework 30 may be held by a thrust step 28 with which the upper walkable portion 14 of the starting block 10 may be provided. The bar 26 and the relative support framework 30 may obviously also be held by any other suitable structural element of the starting block 10, such as for example one or more guides 32 obtained on the upper walkable portion 14 and/or on the thrust step 28 of the starting block 10. This allows applying the support means 18 also to pre-existent starting blocks without leading to any construction modifications. Once the swimmer starts the backstroke, a similar support means 18 may be manually and easily removed from the starting block 10 and placed on the edge swimming pool.

Figure 8:
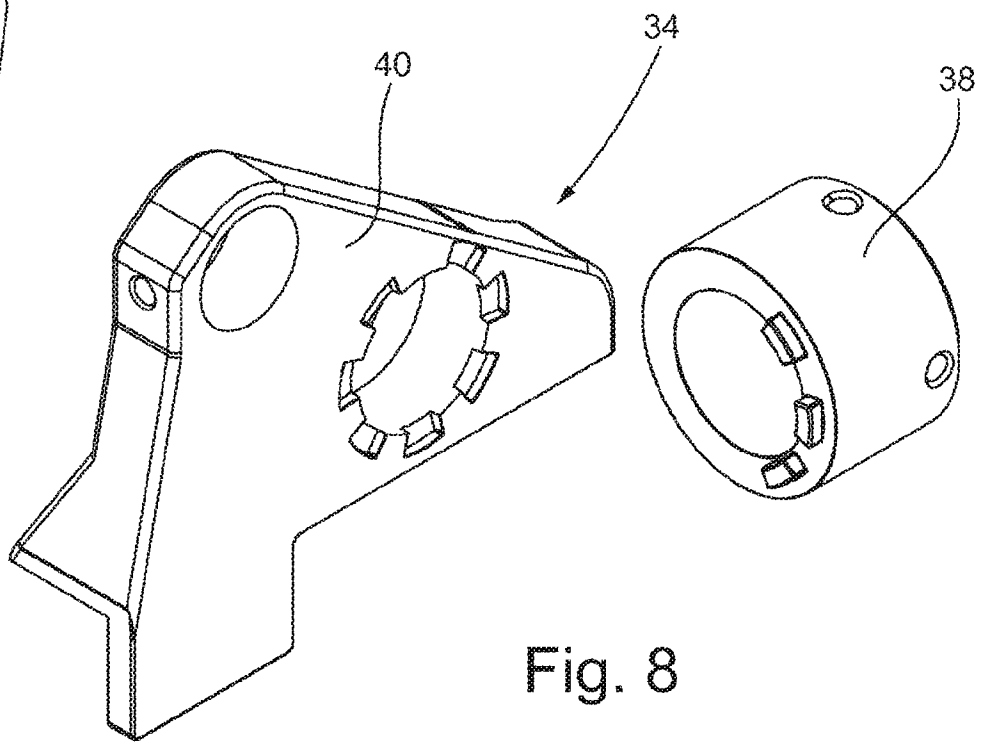
FIG. 8 is another perspective view of the means for adjusting the starting block of FIG. 5.
Figure 7:
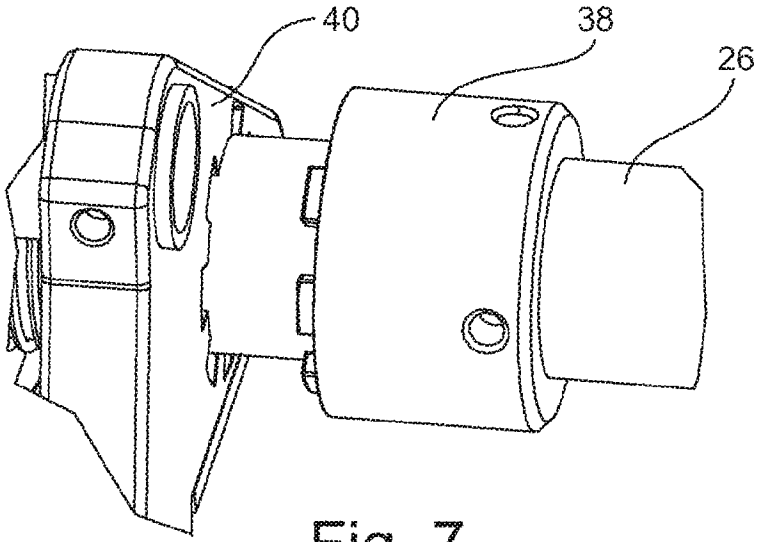
FIG. 7 is a perspective view of the means for adjusting the starting block of FIG. 5.

The length-wise adjustment of the belts 24 may be obtained through a step-by-step adjustment mechanism 34 with a plurality of positions (FIGS. 7 and 8), installed on the bar 26 and on the relative support framework 30. In detail, the step-by-step adjustment mechanism 32 comprises a reel 36, integral with each end of the bar 26, on which there is wound each single belt 24. At each reel 36 there is provided a toothed ring nut 38, operatively connected to the bar 26 through a spring so that such toothed ring nut 38 may exclusively perform an axial movement, limited to some tenths of millimetres, with respect to the bar 26.

The toothed ring nut 38, when pushed by the relative spring, is configured so as to be engaged with a shaped block portion 40 of the support framework 30 for blocking the rotation movement of the bar 26 with respect to the support framework 30, thus avoiding the winding/unwinding of each single belt 24 with respect to the relative reel 36. Vice versa, when the toothed ring nut 38 is moved manually along the axial direction of the bar 26, overcoming the force of the relative spring, there occurs the disengagement of the toothed ring nut 38 from the corresponding shaped block portion 40 of the support framework 30. Thus, this configuration allows performing the operation of winding/unwinding each single belt 24 with respect to the relative reel 36, thus allowing an easy adjustability, even by the swimmer, of the height at which the support means 18 is arranged.

Thus, it cannot be excluded that the support means 18 can be obtained according to other embodiments different from those illustrated in the attached figures, thus there cannot be excluded the possibility of modifying the components constituting the support means 18. Thus, for example, in the rest position the plate 20 could represent a surface on which a sponsorship sticker can be applied, not only due to the fact that it is exposed to the view of the public watching the swimming competition, but also due to the extra attention that the movement of the support means 18 generates always. The plate 20 could also support a device for detecting possible movements of the swimmer before the start signal, so as to identify a false start.

It has thus been observed that the improved starting block for swimming pools according to the present invention attains the previously described objects. Such improved starting block may be installed on any type of swimming pool, prefabricated or not, without altering the method of construction of such swimming pool, or it may be installed on previously built swimming pools.

The improved starting block for swimming pools of the present invention thus conceived can however be subjected to numerous modifications and variants, all falling within the same inventive concept; furthermore, all details can be replaced by technically equivalent elements. In practice the materials used, as well as the shapes and dimensions, may vary according to the technical requirements.

The scope of protection of the invention is thus defined by the attached claims.

The invention claimed is:

1. A starting block for swimming pools comprising:

a base portion, constrainable to the perimetrical structure of the swimming pool at one head vertical wall of said swimming pool;

an upper walkable portion, supported by said base portion and aligned with said head vertical wall of said swimming pool so as to be used as a platform by a swimmer;

one or more handgrips, protruding from said base portion towards an internal part of said swimming pool and useable by a swimmer during starting stages of a swimming competition; and a support means for supporting feet of said swimmer, said support means being operatively connected to said starting block and provided with a moving system which allows said support means to move between an operating position, wherein said support means leans against said head vertical wall so as to form a step which is inclined with respect to said head vertical wall and facing upwards, and a rest position, wherein said support means is outside the swimming pool and does not represent an obstacle for swimmers who are inside said swimming pool or on said starting block wherein said support means is made up of a plate constrained to said starting block by means of belts, and wherein said belts are in turn constrained to said starting block through a bar rotatably connected to a support framework removably constrained to said starting block so that, after a swimmer starts, said support means can be manually and easily removed from said starting block.

2. The starting block according to claim 1, wherein the inclination of said support means with respect to said head vertical wall is adjustable so as to always form an ideal angle for maximum efficiency of a thrust action of a swimmer during a starting stage of a backstroke swimming competition.

3. The starting block (10) according to claim 1, wherein said support means, in an operating position, is configured so as to be at least partly immersed in said swimming pool.

4. The starting block according to claim 1, wherein said belts are adjustable length-wise to modify the depth of said support means (18) with respect to an edge of said swimming pool.

5. The starting block according to claim 4, wherein a length-wise adjustment of said belts is obtained through a step-by-step adjustment mechanism with a plurality of positions, installed on said bar and on said relative support framework.

6. The starting block according to claim 5, wherein said step-by-step adjustment mechanism comprises two reels, integral with each end of said bar, on which each single belt is wound, at each of said reels there being provided a toothed ring nut, operatively connected to said bar through a spring so that said toothed ring nut may exclusively perform an axial movement with respect to said bar so that, when it is pushed by said spring, said toothed ring nut being configured so as to be engaged with a shaped block portion of said support framework for blocking rotational movement of said bar with respect to said support framework, thus avoiding a winding/unwinding of said each single belt with respect to said reels, and when said toothed ring nut is moved manually along an axial direction of said bar to overcome a force of said spring, there occurs a disengagement of said toothed ring nut from a corresponding shaped block portion, thus making possible an operation of winding/unwinding each single belt with respect to the relative reel.

* * * * *